US005092094A

United States Patent [19]

Duda et al.

[11] Patent Number: 5,092,094

[45] Date of Patent: Mar. 3, 1992

[54] HINGEABLE EXPANSION JOINT FOR COVERED PANELS

[76] Inventors: Robert W. Duda, P.O. Box 649, Blairstown, N.J. 07825; James V. Baldwin, 1023 State Park Rd., Chester, N.J. 07930

[21] Appl. No.: 665,974

[22] Filed: Mar. 7, 1991

Related U.S. Application Data

[63] Continuation-in-part of Ser. No. 519,850, May 7, 1990, Pat. No. 5,020,294.

[51] Int. Cl.[5] ..... E04B 1/68; E04F 15/14

[52] U.S. Cl. ..... 52/573; 52/459; 52/470; 404/57

[58] Field of Search ..... 52/395, 396, 573, 406, 52/467, 470, 459; 404/56, 57, 58, 59

[56] References Cited

U.S. PATENT DOCUMENTS

| | | | |
|---|---|---|---|
| Re. 28,408 | 5/1975 | Nelsson | 52/36 |
| 1,153,152 | 9/1915 | Brucker . | |
| 1,864,130 | 3/1930 | Gibian . | |
| 2,116,846 | 7/1936 | Pilcher . | |
| 2,803,858 | 6/1955 | Rader . | |
| 3,372,521 | 6/1965 | Thom | 52/395 |
| 3,390,501 | 7/1968 | Driggers | 52/395 |
| 3,408,782 | 11/1968 | Kovacs | 52/220 |
| 3,659,390 | 5/1972 | Balzer | 52/573 |
| 3,745,726 | 7/1973 | Thom | 52/98 |
| 3,994,609 | 11/1976 | Puccio | 52/396 |
| 4,067,155 | 1/1978 | Ruff et al. | 52/105 |
| 4,071,994 | 2/1978 | Ammann | 52/573 |
| 4,111,582 | 9/1978 | Tippett | 404/47 |
| 4,774,795 | 10/1988 | Braun | 52/396 |
| 4,784,516 | 11/1988 | Cox | 404/69 |
| 4,838,851 | 5/1989 | Ohmatsu | 52/396 |

*Primary Examiner*—John E. Murtagh

[57] ABSTRACT

An expansion joint for covered floor panels such as concrete slabs, as well as wall and ceiling panels, has a thickness equal to a covering material on the panels and is surface mounted. An expansion joint member having hingeable lateral sections bridges across substantially abutting panels at a gap which may vary laterally, longitudinally or in elevation. A U-shaped body portion incorporating the hingeable lateral sections has a width greater than a maximum width of the gap, and fasteners adjacent one side of the gap for affixing the body portion to the panel at an attachment side of the joint. The body portion bridges across the gap and carries a strip of the covering material. The lateral section opposite from the attached lateral section may rotate downwardly at the hinge, to rest freely on the surface of the panel on an opposite side of the gap. Wing members on the hinged lateral sections extend laterally outwardly at a height equal to the thickness of the covering material side. The wing on the side opposite from the attachment side can bend upwardly in the event of unequal elevation of the panels, and abutments limit the extent of relative rotation of the lateral sections.

15 Claims, 2 Drawing Sheets

HINGEABLE EXPANSION JOINT FOR COVERED PANELS

CROSS REFERENCE TO RELATED APPLICATION

This is a continuation in part of application Ser. No. 519,850, filed May 7, 1990, now U.S. Pat. No. 5,020,294.

BACKGROUND OF THE INVENTION

1. Field of the Invention

This invention relates to the field of expansion joints for substantially abutting slabs or panels wherein the joint is to be covered by a facing or covering material. In particular, the invention concerns an expansion joint between abutting decks in a building, to be covered with a facing material such as carpeting, tile or the like. In addition to accommodating expansion and contraction of a gap between the panels at the joint, the invention accommodates displacement of the panels from a coplanar relationship, for example due to unequal settling of the supports for the panels. The invention also applies to expansion joints in walls, ceilings, etc., wherein a facing material is to be placed smoothly over a varying gap between abutting panels which may be displaced from a nominally coplanar relationship.

2. Prior Art

An expansion joint in a floor, wall, ceiling or other structure joins two members defining substantially coplanar surfaces on at least one side, the two members generally abutting along a line but defining a gap between them. The width of the gap and the coplanar relationship of the two members vary over time. The width of the gap can change, for example, as a function of temperature and load variations on the means supporting the two members. Such variations may be periodic or may proceed slowly over a long time. For example, the two members can be displaced from a coplanar relationship if the supports for one of them settles more than the supports for the other. Although the span of displacement is typically small, the forces behind the displacement are substantial. To avoid cracking and similar structural failure of a rigid element of a structure or the means supporting the element, an expansion joint divides the element in two and allows the two parts to move relative to one another in a flexible manner over a limited span.

Known expansion joints have a number of objectives relating to maintaining a connection between the two relatively movable members notwithstanding the gap, and/or maintaining a smooth surface over the gap, for example for bearing traffic, and sealing between the two members. It is possible for a panel at an expansion joint to move relative to the other panel in a direction in its plane or perpendicular to its plane. Displacement in the plane either varies the gap width or simply causes the panels to be displaced longitudinally along the gap. Displacement perpendicular to the plane can result in a change in elevation as the panels remain parallel, or the panels can become rotated. It is usually desirable that the joint not define a discontinuity in the surface defined by the abutting slabs, panels or the like. In a floor expansion joint for example, a discontinuity on an upper surface is a tripping hazard.

Where a joint on a floor, wall, ceiling or the like is to be covered for example by carpeting, wall coverings, etc., a discontinuity may form in the covering material that is a bigger problem than the displacement of the panels at the joint This problem is not resolved even if the panels at the expansion joint remain coplanar or at least the facing edges of the panels remain parallel. Although an expansion joint structure may be arranged to hold the facing edges of the panels to maintain a smooth upper surface for the joined members, a discontinuity occurs in the covering material which passes over the joint. The discontinuity of course varies with the gap between the abutting members.

If one attempts to merely cover over an expansion joint between two panels, problems arise from the need to maintain an even upper surface and thereby avoid a tripping hazard. For example, it is possible to attach a flat strip of metal or other stock to cover the gap in an expansion joint. The strip is attached to one of the panels and allowed to extend across the gap to lap over the other panel by an amount greater than a span of variation in the width of the gap. To avoid raised edges, settable floor compound can be applied adjacent the strip and feathered (made progressively thinner) proceeding away from the strip to form a very gradual hump up to the level of the thickness of the strip, which lays on top of both panels in the area of the joint, but is attached only to one. Such feathered floor compound is effective to avoid a tripping hazard on the side of the joint where the strip is attached to one of the panels. On the other side, however, expansion causes a gap to open between the extreme edge of the strip and the edge of the flooring compound. Contraction of the joint exerts a pressure between the strip and the flooring compound tending to break away the flooring compound or causing the strip to bow upwardly. If the panels vary in height, the strip may be raised above the surface of the lower panel (if attached to the higher panel) or bent upwardly (if attached to the lower panel) In any of these cases, this technique is not effective to obtain a smooth upper surface without a tripping hazard in at least some of the conditions of the expansion and/or contraction of the gap.

A covering bridging over the gap further complicates the issue. The abutting members of an expansion joint are generally relatively movable laterally toward and away from the gap, but also may be movable longitudinally along the gap. Both forms of relative movement present the possibility of a bulge, ripple or similar discontinuity in any covering material. Assuming that it is possible to provide an expansion joint with variable length connecting structures that maintain a smooth upper surface, such structures still do not solve problems associated with covering layers, particularly of flexible material, applied over the gap. A carpet applied over a gap, for example, will bulge when the gap closes and will stretch or pull away from its moorings when the gap opens, even if the expansion joint applied to the floor is fully effective to maintain a smooth upper surface of the joined members. When the joined members are relatively displaced in height, the same displacement occurs in the covering material. There is a need to resolve the problems associated with expansion joints where the joint is to be covered, particularly where the members at the joint can vary in height.

In known expansion joint structures, connection flanges forming the opposite sides of the joint across the gap are rigidly fixed to the edges of the two members to be joined across the gap, and flexible or length-variable elements of the joint bridge across these rigidly-fixed flanges. The flanges are arranged flush with the surfaces of the two members, typically on the upper surface and also on the surface facing the gap. This requires that a space be formed in the two members for receiving the joint flanges such that the joint flanges are flush with the top surface and the end faces of the joined members U.S. Pat. No. 3,372,521—Thom discloses a floor joint cover assembly wherein bolts are embedded in both members of a floor joint formed of cast slabs, and the upper edges of the members at the end faces adjacent the joint are contoured to a shape complementary with the joint flanges. The structure must be installed when the slabs are not yet hardened, such that the bolts can be embedded and the complementary shape formed. It is possible in a joint of this type to mill out the area of the slabs to be occupied by the joint flanges after the slabs are set, or to devise molding frames of a shape complementary with the joint flanges, such that the necessary shape is obtained when poured slabs set. However, both these alternatives are complex and expensive. Moreover, the resulting joints do not resolve the problems of flexible coverings such as carpets.

U.S. Pat. No. 3,390,501—Driggers (see FIG. 2) discloses a joint having a structure that protrudes upwardly from the joint in the area of the gap, by an amount equal to the height of finish material such as plasterboard, which finish material abuts the protruding portions of the joint at both sides. This is an alternative to a joint similar to that of Thom, wherein anchoring structures must be embedded in a wet or green slab. The joint may be useful where the facing material (e.g., plasterboard) on the slab on either side of the joint is rigidly connected to the slab, and in view of the rigid structures of the slab and facing material, the composite structure is similar to that of Thom in that the joint resides flush in a complementary contour formed at the facing edges of the two rigid composite joined members. Notwithstanding these aspects, the Driggers joint defines a surface discontinuity and a resulting tripping hazard if the joint is used for floors.

One method of minimizing problems with gapping at an expansion joint is to provide a cover panel that floats between the end faces of the joined members, and means for centering the floating cover panel. An example is disclosed in U.S. Pat. No. 3,745,726—Thom. This means for dealing with the gap effectively reduces the extent of gap by splitting the gap in half, i.e., producing a smaller gap at each side of the floating panel rather than one full width gap. Nevertheless, gap problems remain.

Other joint structures having joint flanges embedded in the material of the slabs or the like are shown in U.S. Pat. Nos. 4,774,795—Braun; 4,784,516—Cox; and, 4,833,851—Ohmatsu. In general, the joints have flanges rigidly attached to the joined slab members, which flanges define a nip area between them over at least a portion of their extension, that encloses a flexible material. If the gap opens or closes, either a bulge will be raised in the flexible material or a gap will open at an edge. Therefore, these joints lack a continuous smooth coverage across the suface of the joint. If the joints are covered by a finish material (rather than simply provided with a finish material reaching just to the respective edges), the finish material will bulge or stretch even if the joint remains smooth.

U.S. Pat. No. 4,111,582—Tippett discloses a flexible material in a nip that is covered over by a continuous covering layer. Assuming that the flexible material is precisely dimensioned and has the necessary range of expansion without bulging, the joint does not arrange for expansion and contraction movements in the covering material. Instead, the slab members are arranged to move relative to the covering material and the covering material is fixed in place by undisclosed means.

There has been a need to simplify expansion joints while ensuring that the joint maintains a smooth upper surface. The complex expansion joints of the foregoing patents are quite expensive in terms of materials. As a result of the need for embedding the joint flanges in the edges of the joined members, such expansion joints are even more expensive to install. The present invention employs a joint apparatus forming a hinge-like two part channel for receiving a covering material in a central area, and having raised flanges or wings that extend over covering material adjacent the joint A base part of the two part channel attaches rigidly on the surface of one of the two panels, with a raised flange or wing extending over adjacent covering material on its side of the joint. Means defining a hinge axis at the bottom of the two part channel are disposed between the panels in the gap. A free part of the two part channel is hingeably coupled to the base part at the means defining the hinge axis and has a raised flange or wing that extends over the covering material on the opposite side of the joint.

The joint apparatus is easily and inexpensively surface mounted. The joint apparatus overlaps the surface covering material by a fixed amount on the attached-side slab or the like, and overlaps by a variable amount on the opposite side, thereby accommodating expansion and contraction. The base part is mounted on the panel expected to remain relatively higher in the event the panels vary in elevation due to settling or the like. Such settling is accommodated by hinging of the base part and free part at the hinge axis.

In the central area of the joint apparatus (i.e., in the channel), the joint apparatus receives a strip of facing material such as a strip of the same covering material which borders the joint, tending to better conceal the joint by providing a relatively uninterrupted extension of facing material across the joint. The joint is effective, accommodates flexible facing material with minimal discontinuity, at a fraction of the cost of other expansion joints in either materials or installation.

SUMMARY OF THE INVENTION

It is an object of the invention to provide an expansion joint for covered members defining a variable gap, which joint is no higher than the covering on the members and is defined by a joint apparatus which accommodates displacement of the members in and perpendicular to a nominal common plane of the members.

It is also an object of the invention to provide an expansion joint which is inexpensive to produce and to install.

It is another object of the invention to provide a traffic-bearing joint that accommodates expansion, contraction and vertical displacement at a gap between rigid underlying members as well as relative movement of a covering material, particularly a flexible covering material such as a carpet.

It is another object to improve the appearance of expansion joints to be used with a surface covered with facing material generally.

These and other objects are accomplished by an expansion joint for floor panels such as concrete slabs, as well as wall and ceiling panels, having a thickness equal to a covering material on the panels and which is surface mounted. An expansion joint member having two longitudinally hinged integral extruded lengths bridges across substantially abutting panels at a variable gap. The joint apparatus has a U-shaped body portion having a width greater than a maximum width of the gap with means defining a hinge connection disposed in the bottom of the U-shape. On a base part side of the apparatus, means are provided for receiving fasteners adjacent one side of the gap for affixing the base part rigidly to a top surface of a base side one of said panels defining an attachment side of the joint. The panels need not be contoured or rabbeted to obtain a flush fitting for the joint apparatus. The U-shaped body portion bridges across the gap and rests freely on the surface of the panel on an opposite side of the gap. The base part and the body part are hingeable over at least a limited span to accommodate relative displacement of the panels in elevation. Wing members are attached to the base part on the base or attachment side and to the free part on the opposite side, in each case at a space from the lower surface of the body portion substantially equal to a thickness of the covering material.

The expansion joint can also include a sealing element for stopping air flow through the gap, the sealing element being a flexible sheet or the like attached to the panels on both sides of the gap. On the attachment side the sealing element can be captured between the joint apparatus and the attachment side panel.

The invention is usefully employed with floor, wall or ceiling expansion joints, but is especially applicable to floor joints intended to bear foot or wheeled traffic. The wings extend along the adjacent surfaces of a floor covering such as a carpet, tile, linoleum or comparable synthetic material, and the joint apparatus defines a central channel wherein a strip of the floor covering can be affixed to cover fasteners passing through the joint apparatus and also to improve the appearance of the joint by virtue of the interspersed strip of facing material. Should the panels at the joint become displaced in elevation, the strip of covering material in the central channel bends smoothly over the joint. However, regardless of lateral, longitudinal or elevational displacement of the panels at the gap, no other discontinuity can occur in the covering material due to the overlapping but unattached relationship of the joint apparatus to the free-side panel, and the overlapping but unattached relationship of the wing members to the covering material on both sides.

BRIEF DESCRIPTION OF THE DRAWINGS

There are shown in the drawings the embodiments of the invention as presently preferred. It should be understood, however, that the invention is not limited to the precise arrangements and instrumentalities depicted as exemplary embodiments, and is capable of embodiment in other forms and groupings of sub-elements. In the drawings.

DETAILED DESCRIPTION OF THE PREFERRED EMBODIMENTS

Figure 1:
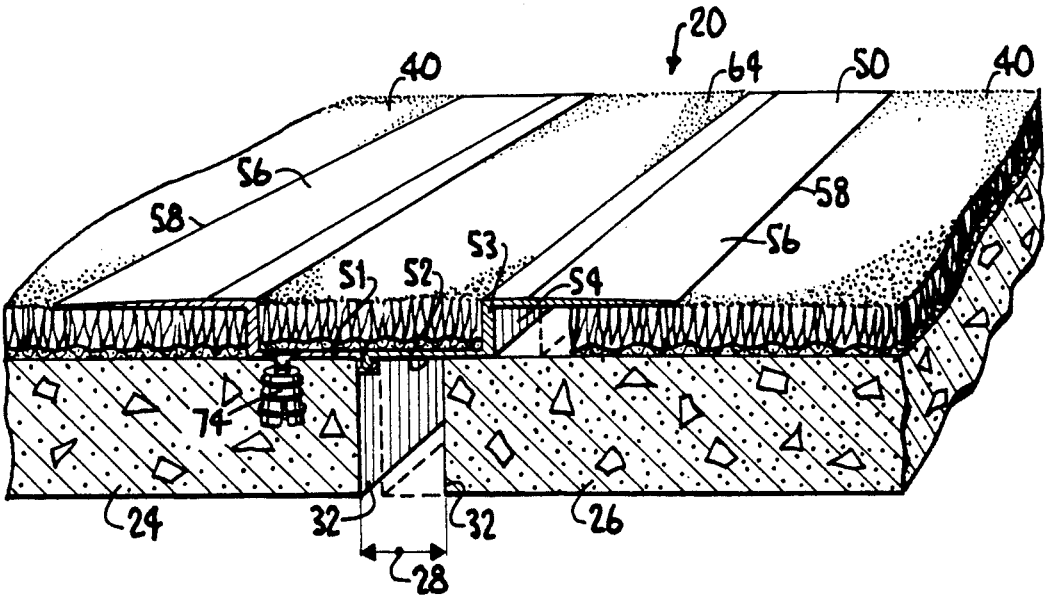
FIG. 1 is a perspective view, partly in section, showing an expansion joint according to the invention as applied to a floor joint subject to displacement parallel to the plane of two coplanar slabs.
Figure 2:
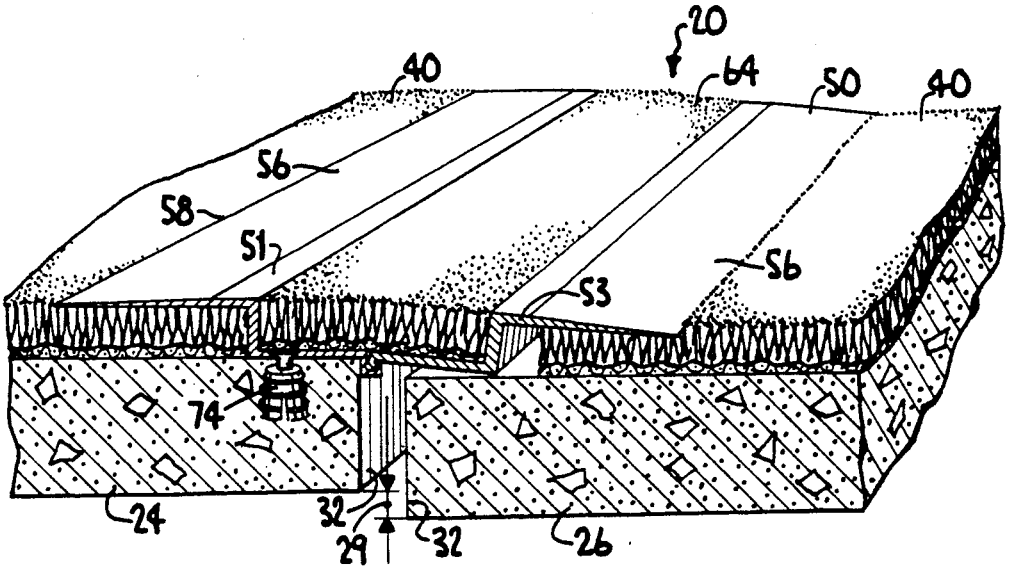
FIG. 2 is a perspective view corresponding to FIG. 1, wherein the slabs are displaced perpendicular to their planes.

The expansion joint 20 of the invention, as applied to a floor expansion joint, is shown in FIG. 1 along a section perpendicular to the longitudinal extension of the joint. In this view the respective slabs 24, 26 at the joint are coplanar, but are subject to displacement relative to one another, for example laterally of the longitudinal extension of the joint, within the space indicated at 28. Such slabs also may become displaced along the longitudinal extension of the joint. According to the invention herein and as disclosed and claimed in parent application Ser. No. 519,850, filed May 7, 1990 (now U.S. Pat. No. 5,020,294), a joint apparatus which is surface mounted on the slabs accommodates the relative displacement of the slabs and provides a smooth transition in the surface covering material across the joint. A channel-like configuration having a central area for receiving covering material and lateral wings or flanges overlapping the adjacent covering material, is attached to one of the slabs 24 and rests freely on the other of the slabs 26. The disclosure of application Ser. No. 519,850, filed May 7, 1990 (now U.S. Pat. No. 5,020,294)is hereby incorporated. Unlike the invention in Ser. No. 519,850, wherein the channel-like member is an integral extrusion or the like, the channel apparatus according to the present invention is formed in hingeably coupled lateral sections, and thus accommodates displacement of the slabs 24, 26 in a direction perpendicular to their respective planes, as shown in FIG. 2.

Figure 5:
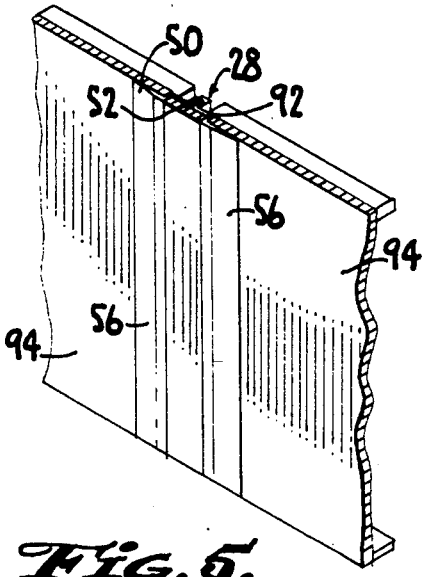
FIG. 5 is a perspective view illustrating a wall expansion joint.
Figure 6:
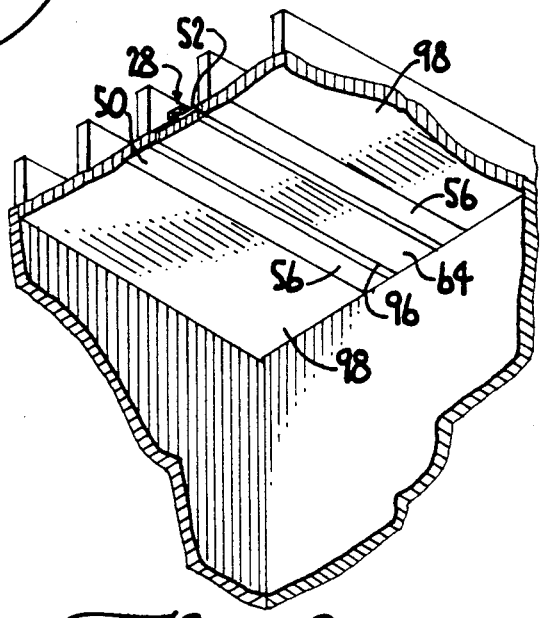
FIG. 6 is a perspective view illustrating a ceiling expansion joint.

An expansion/displacement joint of this type is typically applied to floor joints, but is also fully applicable to other joints in structures to which a covering material is applied. FIGS. 5 and 6 represent comparable joints applied to a wall and a ceiling, respectively. As shown in FIG. 1, the joint is formed between two panels 24, 26, which in connection with a floor joint may typically be concrete slabs. The joint is also fully applicable to other materials for the joined members. The panels or slabs 24, 26 are supported in the building or the like by structural elements which are not shown. For reasons well known in the building arts, relative movement of the slabs occurs due to diverse influences on their supporting elements, requiring that a clearance or gap 28 be provided between the abutting or nearly abutting end faces 32 of the slabs 24, 26. As the building moves and with periodic expansion and contraction due to thermal influences, forces are applied causing the gap 28 to open and/or close. To allow the joint to vary without buildup of pressure, the gap must be wide enough that at the maximum relative displacement of the panels toward one another, the end faces of the panels barely come into contact. If the gap was not provided, the forces would tend to cause cracking of the floor or the structural members supporting it. According to the invention, the gap is slightly wider than the minimum necessary for this purpose, to allow a space for the hinging structure coupling the lateral sections 51, 53 which together form the joint member 50.

The expansion joint for a floor frequently falls in a traffic area. Whereas it would be possible to simply bridge the gap with a flange-like strip, it would then be necessary to either cut out a rabbet in each of the floor panels to accommodate the strip or smoothly to raise the level of the floor adjacent the strip by means of a flooring compound or the like, in order to prevent a discontinuity in floor height that would become a tripping hazard. Unfortunately, a gap would still open and close between the strip and the edge of the rabbet. If no gap was provided, the strip would bulge or would break away portions of the floor panel at its edge.

Assuming that an expansion joint has an appropriate structure to provide a smooth upper surface on the slabs 24, 26, such structure does not prevent a discontinuity in the covering material with movement of the slabs. Where the covering material passes over the joint in an uninterrupted manner, contraction at the joint bulges the covering material. Expansion at the joint places tension on the covering material. According to the invention, the covering material is interrupted at the joint. The covering material on opposite sides of the joint is allowed to move with the slab on the respective side. The joint member overlaps the edges of the covering material, by an amount sufficient to accommodate the slab displacement on the side which is not attached to one of the slabs. A central channel receives a strip of covering material to minimize the interruption of the covering material by the joint.

The joint member 50 in the embodiment shown has lateral sections 51, 53 forming a laterally winged channel. One of the lateral sections 51 is attached to one of the panels 24, which can be considered the base panel or attachment side panel. The other of the lateral sections 53 slides freely on the upper surface of the other of the panels 26. Each of the lateral sections 51, 53 has a wing or flange 56 that extends laterally outwardly from the joint, substantially at the elevation defined by the upper surface of the covering material. The lateral wings 56 on the sides of the joint member extend over and overlap the covering material 40 to provide a smooth transition from the covering material to the joint member.

Figure 3:
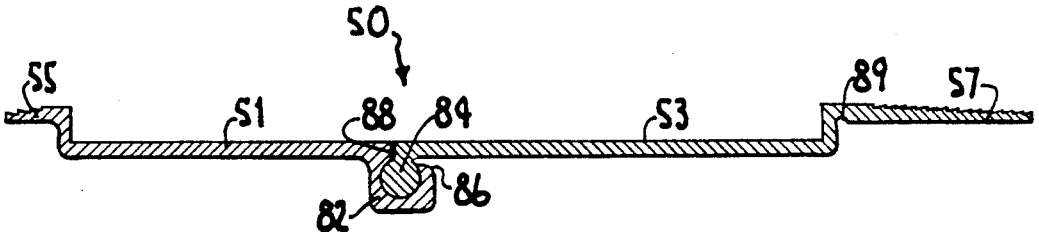
FIG. 3 is a section view through the joint apparatus, perpendicular to the longitudinal axis of the joint.

On the attachment side panel 24, there is no relative movement required between the covering and the joint apparatus (although relative movement is possible). Therefore, as in a preferred embodiment shown in FIG. 3, the wing 55 on the attachment side can be relatively short. On the opposite side panel 26, the body portion 52 of the joint apparatus 50 slides relative to the panel 26 on that side, and the wing 56 (FIGS. 1 and 2) similarly slides over the upper surface of the covering. As shown in FIG. 3, the wing 57 on the sliding side can appropriately be relatively longer, in order to accommodate the relative movement of the panel 26 and its covering material 40. The result is a flat joint that accommodates expansion without bulging, breakage or other problems of flush joints, and also accommodates a covering material, likewise in a manner that does not cause the covering material to gap or to bulge.

The joint apparatus 50 has a body portion 52 of a width greater than a maximum width of the gap 28. Adjacent one end face 32 of the panels, namely at the end face of panel 24 on an attachment side of the joint, the body portion 52 of the joint apparatus 50 can be rigidly affixed to the respective panel 24. In particular, the underside of the body portion 52 is disposed against and fixed to the upper surface of panel 24. This fixes the bottom of lateral section 51 at a level coplanar with the upper surface of panel 24. Provided the slabs 24, 26 remain coplanar (i.e., displacement is limited to lateral and longitudinal movement relative to the joint), the bottom of the other lateral section 53 is positioned coplanar with the top of slab 26 on the opposite side. Joint apparatus 50, and more particularly body portion 52 thereof, bridges across the gap 28 and rests freely on the upper surface of panel 26 on the opposite side of the gap. With expansion and contraction or longitudinal slippage, joint apparatus 50 remains stationary relative to panel 24, and slides over panel 26 as well as the covering 40 on panel 26.

With reference to FIG. 1, a first wing member 56 is attached to the body portion 52 of joint apparatus 50 on the attachment side of the joint, at a space above the lower surface of the body portion 52. This space is substantially equal to the thickness of the covering material 40 on the attachment side, and accordingly the wing 56 is disposed along the surface of the covering 40, which the wing overlaps for at least a short distance. A second wing member 56 is attached to the body portion 52 of joint apparatus 50 on the opposite side, namely over panel 26. This second wing member is also attached to the body portion 52 at a space above its lower surface substantially equal to the thickness of the covering material 40 on the opposite side. With expansion and contraction of the joint, the second wing 56 slides back and forth on the upper surface of the covering material 40. Covering material 40 is spaced back from the body portion 52 or joint apparatus 50 by an amount equal to or greater than the maximum displacement of the gap 28. Therefore, when the gap 28 is at its minimum, the edge of the covering material 40 does not abut the body portion 52, and never is caused to bulge.

The body portion 52 and the first and second wings 56, 56 are preferably integral portions of the lateral sections 51, 53 of expansion joint apparatus 50, each of which can be extruded or otherwise formed in a sheet-like configuration. The joint apparatus can be formed of folded or bent sheet material, particularly where the joint is not intended to experience traffic, for example in a wall or ceiling joint.

The body portion 52 defined between the flanges or wings 56, 55, 57 is U-shaped in cross-section, defining an internal channel 62. Inasmuch as the material of the joint apparatus is relatively thin, the channel 62 is of appropriate depth for receipt of a strip 64, preferably of the same covering material 40 which covers panels 24, 26. The strip can be adhesively affixed in place, covering the fasteners which affix the body portion 52 to the attachment-side panel. The strip interrupts the visual appearance of the joint apparatus, which is preferably extruded metal, plastic or the like, tending to visually conceal the expansion joint.

The first and second wings 56 or 55, 57 preferably are tapered in thickness toward edges thereof remote from the body portion. The wings can be at least slightly resilient, and can be slightly inclined downwardly on their upper surfaces, tending to form a ramp-like transition to the highest point of the joint apparatus at the edges of the U-shaped body portion. Preferably, the compression of the covering material 40 under the wings 56 is minimal at least so long as the slabs remain coplanar, whereby the covering material is relatively free to slide relative to the wings 56 or 55, 57 as the joint expands or contracts.

Figure 4:
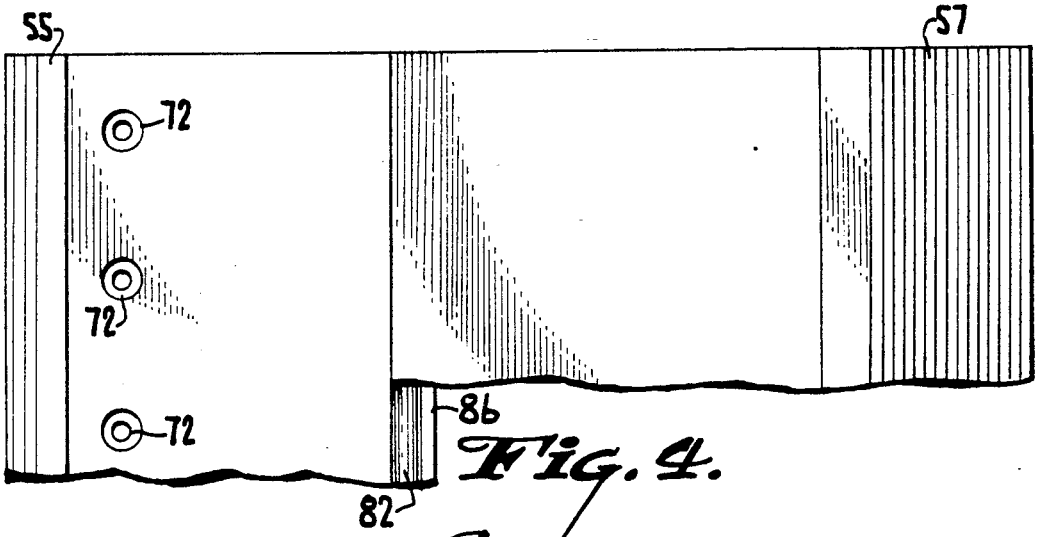
FIG. 4 is a plan view of the joint apparatus of FIGS. 1–3.

The wings can be provided with anti-slip roughened upper surfaces (e.g., ribs), as shown in FIGS. 3 and 4. The wings can also be provided with decorative aspects such as surface designs, scalloped edges and the like. It is preferred, however, that the undersides and edges of the wings be smooth, to avoid binding the covering material in a manner that would prevent free relative sliding of the covering material relative to the wings.

The body portion 52 of the joint apparatus 50, and more particularly the base side lateral section 51, is affixed to the panel 24 on the attachment side of the gap by fasteners disposed adjacent an edge of the body portion. The fasteners, for example countersunk screws, can be placed at the extreme edge of the bottom of U-shaped body portion 52, such that the fasteners in use are spaced back from the extreme edge of panel 24 and are less likely to cause chipping or breakage of panel 24. In an embodiment for a carpet covered expansion joint for concrete panels, for example, the bottom of the body portion 52 can be four inches wide and ⅛ inch thick extruded aluminum, with the centerlines of countersunk holes 72 for the fasteners 74 about ¼ to ⅜ inch from the vertical wall of the U-shaped portion. The wings in this embodiment can be, for example, two to four inches in width, with the taper of the wings commencing at a space (e.g., one inch) from the vertical wall and proceeding to a minimum thickness of 3/32 inch at the outer edge of each wing, where the extreme edge is rounded. Other dimensions are of course possible. It is also possible to attach the body portion to the panel using structural adhesive rather than a screw or similar discrete fastener.

The invention is likewise applicable to a wall joint 92 as shown in FIG. 5, with a covering material 94 such as panelling, gypsum board (and/or filling compound), flexible sheet covering or the like; as well as to a ceiling joint 96 with a covering material 98 as shown in FIG. 6. The dimensions of the joint apparatus are varied according to the gap dimensions and to the situation, with relatively narrower wings being apt for more decorative and non-traffic-bearing applications.

The expansion joint of the invention comprises two coextensive panels 24, 26 substantially abutting at a variable gap 28 having a maximum and minimum width which may change over time. A covering material 40 is disposed on the panels 24, 26, the covering material 40 extending on each side of the gap 28 to a point spaced back from the gap. A joint apparatus 50 with a body portion 52 has a width greater than a maximum width of the gap 28, and means 72 adjacent one side of the gap for affixing the body portion 52 to one of said panels 24 defining an attachment side of the joint, the body portion 50 being affixed against the surface of the panel 24 on said attachment side, the body portion 50 bridging across the gap 28 and resting freely on the surface of the panel 26 on an opposite side of the gap 28. A first wing member 56 or 55 is attached to the body portion 52 on the attachment side 24 at a space from said lower surface of the body portion 52 substantially equal to a thickness of the covering material 40 on said attachment side 24, and a second wing member 56 or 57 is attached to the body portion 52 at a space from said lower surface of the body portion 52 substantially equal to a thickness of the covering material 40 on said opposite side 26, said first and second wing members 56 extending over the covering material 40 on both sides of the gap 28.

The body portion 52 is affixed to the panel 24 on the attachment side of the gap 28 by fasteners 74 disposed adjacent an edge of the body portion 52. The body portion 52 of the expansion joint apparatus 50 preferably is formed of sheet material with a hinge joint defined by engaging structures aligned axially along the joint. The body portion 52, including the inward portions of the hingeable lateral sections 51, 53, is U-shaped in cross-section when the slabs 24, 26 are coplanar. A length 64 of the covering material 40 is disposed in the U-shaped cross-section 62 of the body member 52 such that said wings 56 and said length 64 of covering material 40 define a continuous surface substantially at a height of the covering material 40. The first and second wings 56 are preferably tapered in thickness toward edges thereof remote from the body portion 52.

* The joint apparatus of the invention is useful alone as well as in addition to other forms of expansion joints. The seal of the invention useful, for example, together with a vapor seal type expansion joint which is attached to the top or facing ends of the panels 24, 26. Seal strip and/or the mounting flanges therefor can be disposed at least partly between the body portion 52 and the panels 24, 26 for sealing air passage through the gap 28. Reference can be made to application Ser. No. 519,850, filed May 7, 1990 (now U.S. Pat. No. 5,020,294) for details of seal strips and mountings therefor.

Preferably, the fasteners 74 are countersunk screws. The expansion joint apparatus 50 can be a length of extruded material of a material chosen from the group consisting of plastic, metal and wood. The preferred material is extruded aluminum, however, brass and similar decorative metals and like materials are also possible. The panels 24, 26 can be floor panels and the covering material can be a flexible sheet material, such as carpet. The panels 24, 26 can also be wall panels or ceiling panels.

A hingeable connection of the lateral sections 51, 53 of the joint apparatus 50 enables the joint to accommodate displacement of the slabs 24, 26 in elevation or coplanar alignment, or both, in addition to accommodation of displacement in a common plane including the joint. A possible hingeable connection is shown in FIGS. 3 and 4. One of the lateral sections 51, 53 of the joint member 50 (section 51 as shown) is provided with an elongated groove or the like, and the other section (53 as shown) has an elongated rib 84 which mates with the groove to define the hinge. Preferably, and as shown in FIG. 3, rib 84 is substantially cylindrical, the outer diameter of the rib 84 corresponding closely to the inner diameter defined by a box-like receptacle 82, to preclude relative movement of lateral sections 51, 53, except for relative rotation about the axis of rib 84.

Receptacle 82 is preferably provided on the attachment side 51 of the joint member 50, and is placed to protrude downwardly into the space between slabs 24, 26, immediately adjacent the end face 32 on the attachment side 24. This arrangement requires that the slabs 24, 26 define a minimum gap at least as wide as receptacle 82. The receptacle 82 could be provided on the opposite side, but placement of the attachment side is preferred to fix the location and alignment of the hinge.

The hinge arrangement is intended to allow the lateral sections 51, 53 to hinge downwardly from their junction rather than upwardly, and to allow only a limited span of relative angular displacement. This avoids a tripping hazard at the edges of the wings 55 or 57 which would extend upwardly from the covering material if allowed to hinge in the other direction. The hinge axis is located below an abutment 88 between the lateral sections 51, 53, which fixes the sections 51, 53 against upward rotation. An abutment 86 contacts the underside of section 53 to fix the maximum extent of downward rotation of section 53 relative to the hinge axis. Where the slabs are expected to remain parallel but to shift in elevation (or already have shifted), the attachment side is the side which remains higher. In the event the elevation of the slabs 24, 26 is to be equal, but the slabs incline laterally downwardly from the joint, the attachment side can be on either of the slabs.

As shown in FIG. 2, the slabs 24, 26 have shifted (either by tilting or vertical displacement) to the point that the upper surfaces of the slabs are no longer at the same elevation, in particular having shifted by a span indicated at 29. The movable side lateral section 53 has rotated downwardly around the hinge axis from the fixed side section 51. The covering material 64 in the channel 50 is now arched over the hinge, but continues to define a smooth transition across the joint without any bulging other than that defined by the difference in elevation itself.

On the movable side 53, the wing 56 is caused by the relative rotation of section 53 relative to slab 26 (on the same side of the joint) to be diverted downwardly and to compress the covering material 40. Where the covering material is relatively incompressible (e.g., tile or linoleum) and the wing is relatively flexible, the wing is bent upwardly to rest on the surface of the covering material. Where the covering material is relatively more flexible (e.g., carpet), the flexibility of the wing 56 on the movable side can be increased as necessary, for example using a weakening groove 89 in the underside of the wing as shown in FIG. 3), such that the wing can bend upwardly to remain flat on the covering material.

If the joint of the invention is installed on slabs 24, 26 which are already disposed at different elevations, the installer can readily bend the wing on the movable side 53 as required. Where the difference in elevation occurs over time, a weakening groove 89, together with traffic over the joint, tend to maintain the movable side wing 56 in the required position to minimize the discontinuity of the covering material at the joint.

The lateral sections 51, 53 can be assembled in the embodiment shown by axially inserting rib 84 into receptacle 82 and sliding the sections 51, 53 into coextensive alignment. Other structures and assembly techniques are also possible. For example, the hinge can be defined at a plurality of short, regularly spaced receptacles 82 and ribs 84 on sections 51, 53, respectively, such that the individual ribs can be placed axially between the receptacles and engaged by sliding the sections 51, 53 over a short axial distance to engage them. Alternatively, the opening between abutments 86, 88 can be dimensioned just slightly smaller than the outer diameter of rib 84 such that the rib 84 and receptacle 82 can be snapped together laterally of the hinge axis. Preferably, rib 84 is large enough relative to receptacle 82 that the section 53 is captive in the receptacle, preventing section 53 from separating from section 51 after installation.

The invention having been disclosed, a number of alternatives and variations will now become apparent to persons skilled in the art. Reference should be made to the appended claims rather than the foregoing specification as defining the scope of the invention in which exclusive rights are claimed.

I claim:

1. An elongated expansion joint apparatus for bridging across panels substantially abutting at a gap, the panels having a covering material on a surface thereof and the panels being subject to relative displacement, the joint apparatus comprising:

a body portion having a width greater than a maximum width of the gap, and means adjacent one side of the gap for affixing the body portion to one of said panels defining an attachment side of the joint, against the surface of the panel on said attachment side, the body portion including two sections hingeably attached at a hinge axis parallel to the joint and the two sections bridging across the gap and resting freely on the surface of the panel on an opposite side of the gap;

a first wing member attached to the body portion on the attachment side at a space from said lower surface of the body portion substantially equal to a thickness of the covering material on said attachment side; and, a second wing member attached to the body portion at a space from said lower surface of the body portion substantially equal to a thickness of the covering material on said opposite side.

2. The expansion joint apparatus according to claim 1, wherein the body portion comprises lateral sections, the lateral sections being formed integrally with the first wing and member and the second wing member, respectively.

3. The expansion joint apparatus according to claim 2, wherein the body portion expansion joint apparatus is formed of sheet material, the body portion being U-shaped in cross-section.

4. The expansion joint apparatus according to claim 3, wherein the body portion defines an internal channel dimensioned for receipt of a length of the covering material.

5. The expansion joint apparatus according to claim 4, wherein the first and second wings are tapered in thickness toward edges thereof remote from the body portion.

6. The expansion joint apparatus according to claim 5, wherein the body portion is affixed to the panel on the attachment side of the gap by fasteners extending through the body portion.

7. The expansion joint apparatus according to claim 4, wherein the hinge is defined by an elongated receptacle on the lateral section at the attachment side of the body portion and an elongated rib on the opposite side of the body portion, the rib being captive in the receptacle.

8. The expansion joint apparatus according to claim 7, wherein the rib is cylindrical and further comprising at least one abutment limiting relative rotation of the lateral sections at the hinge.

9. The expansion joint apparatus according to claim 8, wherein the lateral sections are limited between a parallel orientation and a maximum rotational displacement by abutments between the lateral sections at a space from an axis of the hinge.

10. The expansion joint apparatus according to claim 9, wherein the second wing is flexible relative to the body portion, and bendable upwardly to rest on a surface of the covering material in a rotated position of the body member.

11. The expansion joint apparatus according to claim 10, wherein the second wing is attached to the body portion at a groove weakening an attachment of the second wing to the body portion to allow upward bending of the second wing relative to the body portion.

12. An expansion joint, comprising:

two coextensive panels substantially abutting at a variable gap and having surfaces;

a covering material on the surfaces of the panels, the covering material extending on each side of the gap to a point spaced back from the gap;

a joint apparatus with a body portion of a width greater than a maximum width of the gap, and means adjacent one side of the gap for affixing the body portion to one of said panels defining an attachment side of the joint, the body portion being affixed against the surface of the panel on said attachment side, the body portion bridging across the gap and resting freely on the coplanar surface of the panel on an opposite side of the gap, a first wing member being attached to the body portion on the attachment side at a space from said lower surface of the body portion substantially equal to a thickness of the covering material on said attachment side, and a second wing member being attached to the body portion at a space from said lower surface of the body portion substantially equal to a thickness of the covering material on said opposite side, said first and second wing members extending over the covering material on both sides of the gap, and wherein the body portion is divided into two lateral, hingeably connected sections along a hinge axis along the joint.

13. The expansion joint according to claim 12, wherein the body portion is shaped as a channel with the wings extending laterally therefrom, and further comprising a length of the covering material disposed in the channel such that said wings and said length of covering material define a continuous surface substantially at a height of the covering material.

14. The expansion joint according to claim 13, wherein the lateral sections are lengths of extruded material of a material chosen from the group consisting of plastic, metal and wood, and wherein the lateral sections are hingeably joined by a longitudinal rib of one of the lateral sections received in a mating receptacle in the other of the lateral sections.

15. The expansion joint according to claim 12, wherein the panels are floor panels and the covering material is a flexible sheet material, bendable to reside in the channel with rotation of the lateral sections.

* * * * *